US012318886B2

(12) United States Patent
Watanabe et al.

(10) Patent No.: US 12,318,886 B2
(45) Date of Patent: Jun. 3, 2025

(54) GRINDING APPARATUS

(71) Applicant: OKAMOTO MACHINE TOOL WORKS, LTD., Gunma (JP)

(72) Inventors: Tetsuyuki Watanabe, Gunma (JP); Keiji Tsuchiya, Gunma (JP)

(73) Assignee: OKAMOTO MACHINE TOOL WORKS, LTD., Gunma (JP)

( * ) Notice: Subject to any disclaimer, the term of this patent is extended or adjusted under 35 U.S.C. 154(b) by 0 days.

(21) Appl. No.: 18/697,251

(22) PCT Filed: Oct. 4, 2022

(86) PCT No.: PCT/JP2022/037113
§ 371 (c)(1),
(2) Date: Oct. 23, 2024

(87) PCT Pub. No.: WO2023/063166
PCT Pub. Date: Apr. 20, 2023

(65) Prior Publication Data

US 2025/0058428 A1 Feb. 20, 2025

(30) Foreign Application Priority Data

Oct. 15, 2021 (JP) ..... 2021-169856

(51) Int. Cl.
*B24B 47/20* (2006.01)
*B24B 41/06* (2012.01)
*B24B 49/04* (2006.01)

(52) U.S. Cl.
CPC ..... *B24B 47/20* (2013.01); *B24B 41/06* (2013.01); *B24B 49/04* (2013.01)

(58) Field of Classification Search
CPC ..... B24B 47/22; B24B 47/20; B24B 49/04; B24B 49/10; B24B 51/00; B25J 11/0065
See application file for complete search history.

(56) References Cited

U.S. PATENT DOCUMENTS

2018/0257195 A1 9/2018 Hasegawa et al.
2020/0223029 A1 7/2020 Yoshida et al.

FOREIGN PATENT DOCUMENTS

EP 1048410 A2 * 11/2000 ..... B24B 47/22
EP 2311600 A1 4/2011

(Continued)

OTHER PUBLICATIONS

International Search Report (ISR) dated Nov. 22, 2022 filed in PCT/JP2022/037113.

(Continued)

*Primary Examiner* — Joel D Crandall
(74) *Attorney, Agent, or Firm* — RANKIN, HILL & CLARK LLP

(57) ABSTRACT

Provided is a grinding apparatus that can efficiently and accurately measure the position of a work surface of a workpiece without preliminary preparations. Included are: a work table (14) configured to hold a workpiece (W); a grinding wheel (10) configured to grind the workpiece (W) while rotating; and a detection sensor (20) configured to detect the position of a work surface of the workpiece (W) in contact with the work surface, and relative positions of the detection sensor (20) and the work table (14) are changed by a manual operation, and the detection sensor (20) is brought into contact with the workpiece (W) to measure the workpiece (W). Consequently, it is possible to omit preliminary preparations for measurement such as creation of an NC program, initial settings, and operation confirmation and perform a highly efficient measurement with a significantly reduced time for the preliminary preparations.

4 Claims, 8 Drawing Sheets

(56) References Cited

FOREIGN PATENT DOCUMENTS

| | | | |
|---|---|---|---|
| JP | H0938859 | A | 2/1997 |
| JP | 2002052444 | A | 2/2002 |
| JP | 2004243468 | A | 9/2004 |
| JP | 2011131320 | A | 7/2011 |
| JP | 2018149621 | A | 9/2018 |
| JP | 2020110893 | A | 7/2020 |
| JP | 2021030377 | A | 3/2021 |
| WO | 2010007685 | A1 | 1/2010 |

OTHER PUBLICATIONS

Written Opinion of the International Searching Authority dated Nov. 22, 2022 filed in PCT/JP2022/037113; English translation.

* cited by examiner

GRINDING APPARATUS

TECHNICAL FIELD

The present invention relates to a grinding apparatus, and more particularly to a grinding apparatus including a contact detection sensor that can measure the position of a work surface of a workpiece efficiently and accurately.

BACKGROUND ART

Some grinding apparatuses that grind a top surface of a workpiece placed on a work table with a grinding wheel supported by a wheel spindle extending in a substantially horizontal direction along a top surface of the work table include a contact detection sensor that detects the position of, for example, the workpiece in contact with a surface of the workpiece.

For example, Patent Literature 1 discloses a surface grinding apparatus including a work table that can reciprocate in a left-and-right direction and a grinding wheel that can move in a front-and-back direction, in which a sensor unit including a touch probe is mounted on a side surface of a wheel head.

A stylus at the tip of the touch probe disclosed in Patent Literature 1 comes into contact with a top surface of a reference block and a top surface of a workpiece, which are provided on the work table. Consequently, the heights from the work table to the top surface of the reference block and the top surface of the workpiece are detected, and a machining allowance to be ground is calculated by a computing means.

Moreover, for example, Patent Literature 2 discloses a surface grinding apparatus that grinds a surface of a workpiece on the basis of relative movement between a rotary grinding wheel mounted on a wheel spindle and the workpiece, the surface grinding apparatus including a touch probe sensor that is a position sensor, on the front side of a safety cover of the grinding wheel.

CITATION LIST

Patent Literature

Patent Literature 1: JP-A-2002-52444
Patent Literature 2: JP-A-2004-243468

SUMMARY OF THE INVENTION

Problems to be Solved by the Invention

However, the above-mentioned grinding apparatuses of the known technologies need to be improved in several ways to efficiently perform highly accurate measurements on a workpiece.

Specifically, the grinding apparatuses of the known technologies measure a workpiece automatically by use of a touch probe on the basis of an NC (Numerical Control) program. In other words, the touch probe or the workpiece is automatically fed on the basis of the NC program, and the touch probe and the workpiece move relative to each other, and the coordinate of the workpiece is read at a position set in the NC program.

Therefore, the grinding apparatuses of the known technologies perform automatic measurement with the touch probe at the time of measuring a workpiece, however, preliminary preparations such as creation of an NC program, initial settings, and operation confirmation are complicated, and a burden on the operator is heavy in a preparation stage before the measurement.

Hence, it is desired to simplify preliminary preparations such as the creation of an NC program to reduce the burden on the operator and improve operational efficiency. However, the grinding apparatuses of the known technologies cannot move the touch probe and the workpiece relative to each other without the NC program, and it is always required to create an NC program in advance to measure the workpiece.

The present invention has been made in view of the above circumstances, and an object of the present invention is to provide a grinding apparatus that can efficiently and accurately detect the position of a work surface of a workpiece without preliminary preparations such as creation of an NC program.

Solution to the Problems

A grinding apparatus of the present invention includes: a work table configured to hold a workpiece; a grinding wheel configured to grind the workpiece while rotating; and a detection sensor configured to detect the position of a work surface of the workpiece in contact with the work surface, in which relative positions of the detection sensor and the work table are changed by a manual operation, and the detection sensor is brought into contact with the workpiece to measure the workpiece.

Effects of the Invention

According to a grinding apparatus of the present invention, the grinding apparatus includes: a work table configured to hold a workpiece; a grinding wheel configured to grind the workpiece while rotating; and a detection sensor configured to detect the position of a work surface of the workpiece in contact with the work surface, in which relative positions of the detection sensor and the work table are changed by a manual operation, and the detection sensor is brought into contact with the workpiece to measure the workpiece. Consequently, it is possible to omit preliminary preparations for measurement such as creation of an NC program, initial settings, and operation confirmation and perform a highly efficient measurement with a significantly reduced time for the preliminary preparations. Hence, it is possible to increase the productivity of the grinding apparatus in terms of the workpiece.

Moreover, according to the grinding apparatus of the present invention, the grinding apparatus further includes: a feeding means configured to feed the detection sensor or the work table and move the detection sensor and the work table relative to each other; a control device configured to numerically control the feed by the feeding means; and an operating means configured to manually input an instruction of a feeding operation of the feeding means into the control device, in which the control device controls the feeding means by a manual operation of the operating means to bring the detection sensor into contact with the workpiece and record a coordinate of a contact point. Consequently, an operator can easily and accurately measure the position of the workpiece by manually inputting a measurement instruction into the operating means without preliminary preparations such as creation of an NC program. Hence, it is possible to reduce the burden of the preliminary preparations on the operator and also significantly reduce the time for the preliminary preparations, and it is possible to encourage an increase in the efficiency of workpiece machining.

Moreover, according to the grinding apparatus of the present invention, after the detection sensor comes into contact with the workpiece by the manual operation of the operating means, the control device may automatically stop the relative movement by the feeding means between the detection sensor and the work table and then automatically control the feeding means to separate the detection sensor and the workpiece. This allows high-speed and safe measurement without damaging the detection sensor or the workpiece due to the contact for measurement.

Moreover, according to the grinding apparatus of the present invention, after the detection sensor comes into contact with and separates from the workpiece, the control device may perform control of feeding the detection sensor or the work table at a lower speed than the first time and bringing the detection sensor and the workpiece into contact with each other. This allows efficiently performing a highly accurate measurement at a reduced feeding speed of the detection sensor or the workpiece a plurality of times. Hence, it is possible to further increase measurement accuracy of measurement in which the first contact step is efficiently performed by an easy manual operation.

Moreover, according to the grinding apparatus of the present invention, after the detection sensor comes into contact with and separates from the workpiece and then the operating means is manually operated to bring the detection sensor and the workpiece into contact with each other again, the control device may perform control of feeding the detection sensor or the work table and bringing the detection sensor and the workpiece into contact with each other. Consequently, easy manual operation allows efficiently performing a highly accurate measurement at a reduced feeding speed a plurality of times.

Moreover, according to the grinding apparatus of the present invention, after the detection sensor comes into contact with the workpiece by the manual operation of the operating means and is separated by automatic control, the control device may feed the detection sensor or the work table by automatic control to bring the detection sensor and the workpiece into contact with and separate from each other. Consequently, automatic control allows efficiently performing highly accurate measurements at the reduced feeding speed.

DESCRIPTION OF THE EMBODIMENTS

A grinding apparatus 1 according to an embodiment of the present invention is described in detail hereinafter with reference to the drawings.

Figure 1:
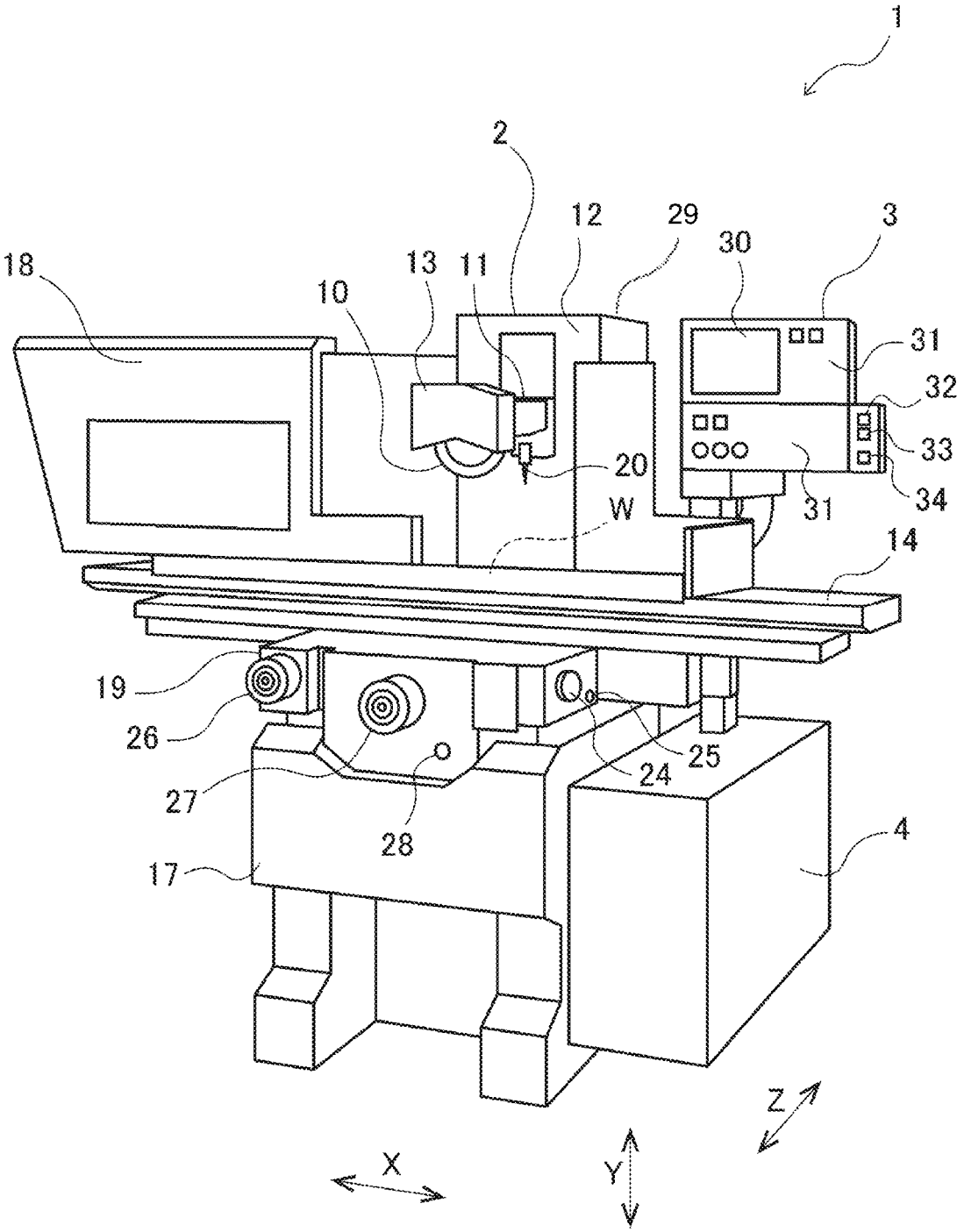
FIG. 1 is a perspective view of a grinding apparatus according to an embodiment of the present invention as viewed obliquely from the front.

FIG. 1 is a perspective view schematically illustrating the grinding apparatus 1 according to the embodiment of the present invention. As illustrated in FIG. 1, the grinding apparatus 1 is a machine tool that grinds a workpiece W. The grinding apparatus 1 includes a grinding machine 2 that grinds a work surface of the workpiece W, a control panel 3 into which, for example, grinding conditions of the grinding machine 2 are inputted, and a control device 4 that numerically controls the grinding machine 2.

The grinding machine 2 may be, for example, a CNC (Computerized Numerical Control) surface grinding machine that performs surface grinding on a top surface or side surface of the workpiece W, a CNC profile grinding machine capable of grinding for the generation of a complicated shape, a CNC rotary surface grinding machine that grinds the rotating workpiece W, or other types of grinding machines.

The grinding machine 2 includes a grinding wheel 10 as a tool that grinds the workpiece W, a work table 14 that holds the workpiece W, and a saddle 16 that supports the work table 14.

The grinding wheel 10 can move relative to the workpiece W in a front-and-rear direction, a left-and-right direction, and an up-and-down direction, and the work surface of the workpiece W is ground by the rotating grinding wheel 10.

Specifically, the grinding wheel 10 is provided in such a manner as to be able to reciprocate in the up-and-down direction (hereinafter referred to as the "Y direction" as appropriate). In more detail, the grinding wheel 10 is provided on a wheel head 11, and the wheel head 11 is supported by a column 12 in such a manner as to be able to reciprocate in the Y direction.

The work table 14 can reciprocate in the left-and-right horizontal direction (hereinafter referred to as the "X direction" as appropriate) and can reciprocate in the front-and-back horizontal direction (hereinafter referred to as the "Z direction" as appropriate), as viewed from the front.

Specifically, the work table 14 is provided above the saddle 16 in such a manner as to be able to reciprocate in the X direction, and the saddle 16 is provided above a frame 17 and is supported on the top of the frame 17 in such a manner as to be able to reciprocate in the Z direction.

The grinding wheel 10, the saddle 16, and the work table 14 are driven by, for example, a servomotor as a feeding means 29 that is controlled by the control device 4, and reciprocate in the above-mentioned directions.

A cover 18 that covers a grinding area where the grinding wheel 10 and the workpiece W are placed may be provided above the work table 14 to prevent, for example, a grinding fluid and grinding debris from being scattered during machining. The cover 18 is provided in such a manner as to be openable and closable to allow an operator to, for example, mount and demount the workpiece W.

The control panel 3 is a device for allowing the operator to input, for example, various settings and instructions for machining, and is provided, for example, on the side of the column 12 and above the work table 14. An operating unit 31 of the control panel 3 is provided with, for example, touch keys, switches, and dials with which the operator inputs, for example, various settings and instructions. Moreover, the control panel 3 is provided with a display unit 30 that displays, for example, various kinds of information on grinding.

The control device 4 includes a central processing unit (CPU), read only memory (ROM), random access memory (RAM), and a storage unit that stores, for example, setting values of machining conditions, and computation results, and performs, for example, various types of control and computations. The control device 4 is connected to the control panel 3, the feeding means, and other various control target devices. Note that the control device 4 may be provided inside the grinding machine 2 or may be provided inside, for example, a housing of the control panel 3.

Note that although not illustrated, the grinding machine 2 is provided with, for example, a grinding fluid nozzle and a grinding fluid supply device, which supply the grinding fluid at the time of machining. Moreover, for example, an unillustrated dressing device that dresses the grinding wheel 10 may be provided above the work table 14.

Moreover, the grinding machine 2 may be provided with, for example, an unillustrated operation button for the operator to perform, for example, a grinding process and a teaching operation, and an unillustrated dog for adjusting the reciprocating position of, for example, the work table 14 in the left-and-right direction.

Figure 2:
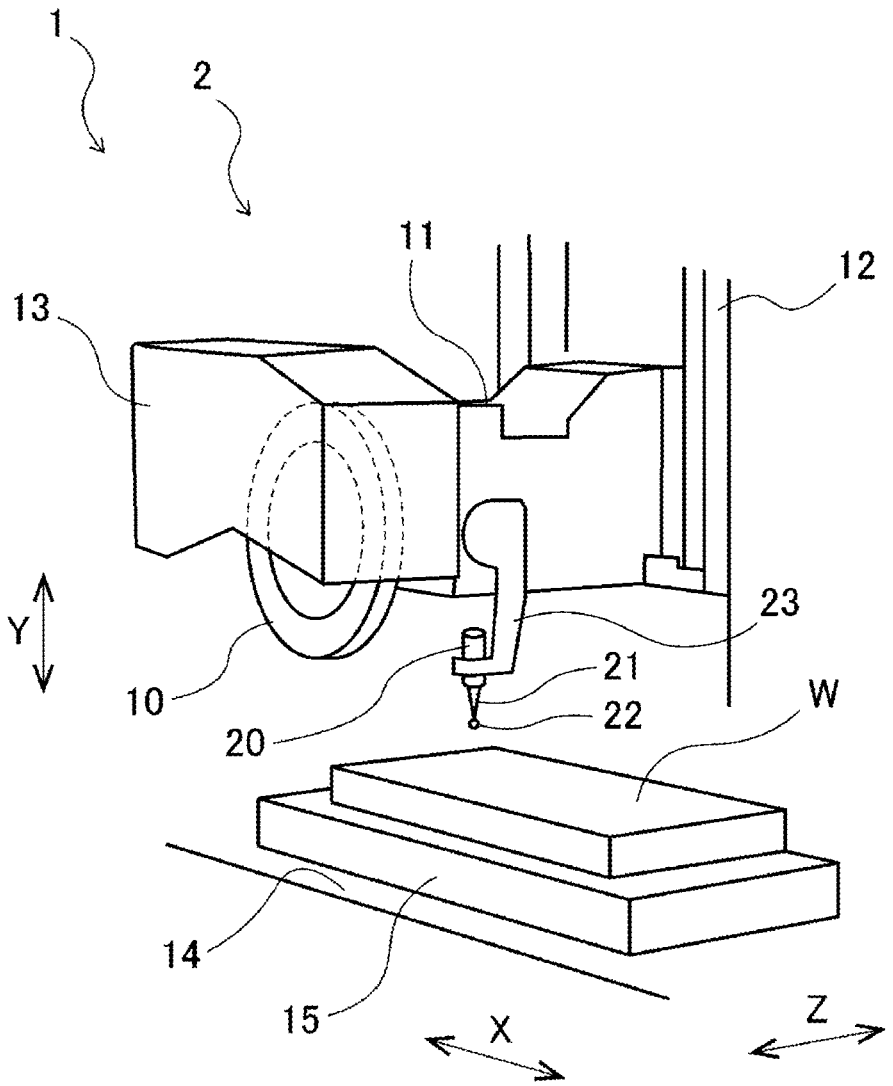
FIG. 2 is a perspective view illustrating the vicinity of a grinding wheel and a work table of the grinding apparatus according to the embodiment of the present invention.

FIG. 2 is a perspective view illustrating the vicinity of the grinding wheel 10 and the work table 14 of the grinding apparatus 1. With reference to FIG. 2, the work table 14 is provided on its top with a chuck 15 that supports the workpiece W. The chuck 15 is, for example, an electromagnetic chuck including an electromagnet therein. The workpiece W is placed on the top of the chuck 15 and is supported by the chuck 15 by magnetic force in such a manner as to be unmovable during machining.

The grinding wheel 10 has an approximately disk shape. The wheel head 11 is provided with an unillustrated wheel spindle that supports the grinding wheel 10, in such a manner that the wheel spindle is rotatable. The grinding wheel 10 supported by the wheel head 11 rotates together with the wheel spindle and moves in the Y direction together with the wheel head 11. Moreover, the wheel head 11 is provided at its front with a wheel guard 13 that covers the upper part of the grinding wheel 10.

The grinding machine 2 includes, for example, an unillustrated rotary driving means, such as a motor, that rotates the grinding wheel 10. The grinding wheel 10 is driven by the rotary driving means and comes into contact with a surface that is the work surface of the workpiece W, while rotating, so that the surface of the workpiece W is ground.

The grinding machine 2 includes the feeding means 29 used to move the wheel head 11 that supports the grinding wheel 10, the work table 14 that supports the workpiece W, and the saddle 16 (refer to FIG. 1). The feeding means 29 includes, for example, a servomotor and a ball screw mechanism that are numerically controlled by the control device 4 (refer FIG. 1). The grinding wheel 10, the work table 14, and the saddle 16 are fed by the feeding means 29 and reciprocate in the above-mentioned directions.

Moreover, the grinding machine 2 includes a detection sensor 20 that measures the shape of the work surface of the workpiece W. The detection sensor 20 is a touch probe that detects the position of a contact point in contact with the work surface of the workpiece W.

The detection sensor 20 includes a probe 21 that detects contact with the workpiece W, and the probe 21 is provided at its tip with a contactor 22 that contacts the workpiece W. The detection sensor 20 is connected to the control device 4 in such a manner as to be able to input a signal into the control device 4, and when the contactor 22 of the detection sensor 20 comes into contact with the workpiece W, then information on the detection by the detection sensor 20 is transmitted to the control device 4.

The detection sensor 20 is supported via an arm 23 in the vicinity of the side of the wheel head 11. The arm 23, for example, rotatably supports the detection sensor 20, and retracts the detection sensor 20 to a retraction position when measurements are not performed. Consequently, it is possible to prevent, for example, damage caused by the detection sensor 20 accidentally coming into contact with, for example, the workpiece W or the chuck 15 during, for example, the grinding process. Note that the detection sensor 20 may be provided in the vicinity of the bottom of the wheel head 11, or the vicinity of the side surface or front surface of the wheel guard 13.

Moreover, a sensor having a two-axis probe 21 may be adopted as the detection sensor 20. Consequently, not only a dimension in one direction but also an up-and-down dimension and dimensions such as a groove width can be efficiently measured with high accuracy.

Figure 3:
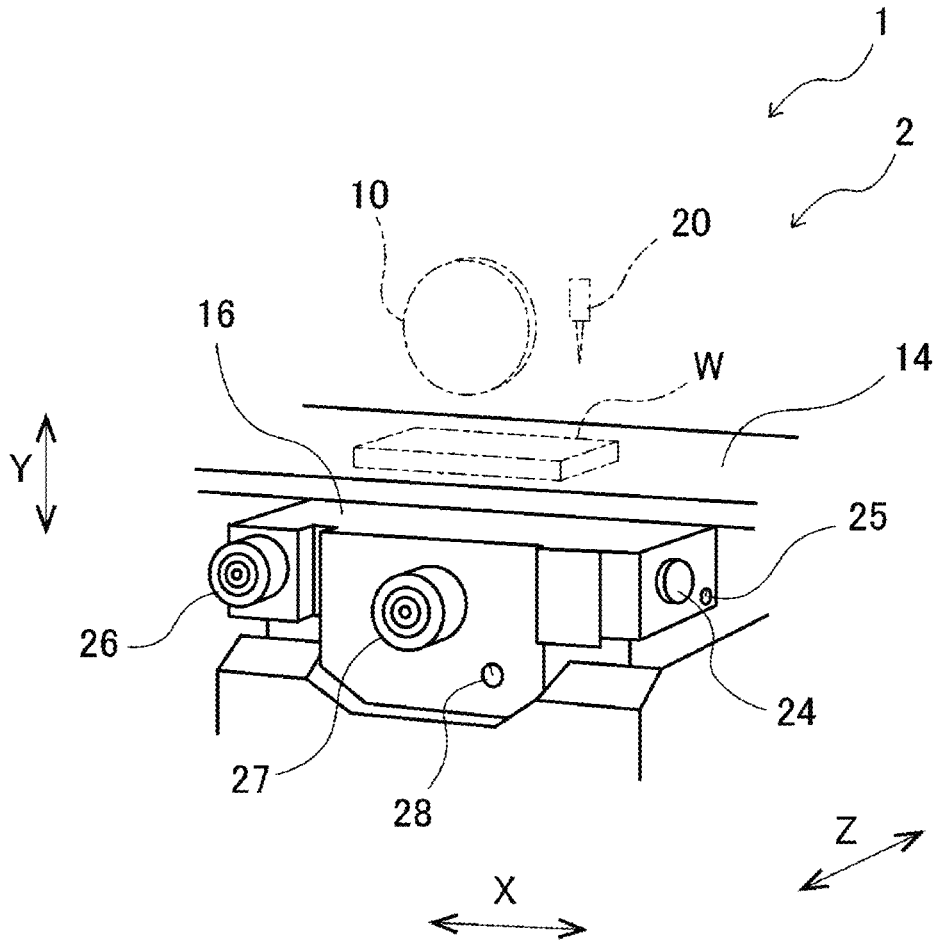
FIG. 3 is a perspective view illustrating the neighborhood of the front of a saddle of the grinding apparatus according to the embodiment of the present invention.

FIG. 3 is a perspective view illustrating the neighborhood of the front of the saddle 16 of the grinding apparatus 1. As illustrated in FIG. 3, the saddle 16 of the grinding machine 2 is provided on its right side surface with an up-and-down feed handle 24. Moreover, the saddle 16 is provided on its front surface with a left-and-right feed handle 26 and a front-and-back feed handle 27.

The up-and-down feed handle 24, the left-and-right feed handle 26, and the front-and-back feed handle 27 are operating means used to manually input an instruction of a feeding operation of the feeding means, and are connected to the control device 4 (refer to FIG. 1) in such a manner as to be able to input a signal into the control device 4.

The up-and-down feed handle 24, the left-and-right feed handle 26, and the front-and-back feed handle 27 are what are called "MPG", and are manual pulse generators that generate pulses by a manual operation by the operator. For example, the servomotor being the feeding means feeds the grinding wheel 10, the work table 14, and the saddle 16 in the predetermined directions by distances corresponding to the number of pulses generated by the manual operation.

Specifically, the up-and-down feed handle 24 is an operating means used to input an instruction to feed the wheel head 11 (refer to FIG. 2) in the up-and-down direction, that is, the Y direction. When the operator turns the up-and-down feed handle 24 provided on the side surface of the saddle 16, then the wheel head 11 moves in the Y direction.

In other words, the operator turns the up-and-down feed handle 24 to move the grinding wheel 10 and the detection sensor 20, which are supported by the wheel head 11, in the Y direction. Consequently, the operator can change and adjust the relative positions of the workpiece W and the grinding wheel 10 in the up-and-down direction.

Put another way, the operator can change and adjust the relative positions of the workpiece W and the detection sensor 20 in the up-and-down direction by turning the up-and-down feed handle 24 manually.

The left-and-right feed handle 26 is an operating means used to input an instruction to feed the work table 14 in the horizontal left-and-right direction, that is, the X direction, and the front-and-back feed handle 27 is an operating means used to input an instruction to feed the saddle 16 in the horizontal front-and-back direction, that is, the Z direction.

The operator turns the left-and-right feed handle 26 to move the work table 14 in the X direction. The operator turns the front-and-back feed handle 27 to move the saddle 16 in the Z direction. Consequently, the operator can change and adjust the relative positions of the workpiece W and the grinding wheel 10 in the horizontal direction.

Put another way, the operator can change and adjust the relative positions of the workpiece W and the detection sensor 20 in the horizontal direction by turning the left-and-right feed handle 26 or the front-and-back feed handle 27 manually.

Note that the left-and-right feed handle 26 may be a feed handle serving as a power transmission means used to move the work table 14 by directly using rotational power inputted by an operation by the operator.

Moreover, an unillustrated changeover switch may be provided which switches between automatic feed in which the feeding means 29 having the servomotor and ball screw mechanism feeds the work table 14 and manual feed that directly uses rotational power by an operation by the operator.

Moreover, the saddle 16 is provided on its right surface with an up-and-down jog feed switch 25, and is provided on its front surface with a front-and-back jog feed switch 28. The up-and-down jog feed switch 25 and the front-and-back jog feed switch 28 are operating means used to manually input an instruction of the feeding operation of the feeding means, and are connected to the control device 4 in such a manner as to be able to input a signal into the control device 4.

Specifically, the up-and-down jog feed switch 25 is an operating means used to input an instruction to feed the wheel head 11 at high speed in the up-and-down direction, that is, the Y direction. The up-and-down jog feed switch 25 is a switch having a lever that allows selection of "up" or "down" and tilting. Only while the operator is tilting the lever, the selected "up" or "down" signal is transmitted to the control device 4, and the wheel head 11 moves in the Y direction at a predetermined speed.

In other words, if the operator tilts the lever of the up-and-down jog feed switch 25 toward "up", the wheel head 11 is raised at the predetermined speed while the lever is being tilted. If the lever of the up-and-down jog feed switch 25 is tilted toward "down", the wheel head 11 is lowered at the predetermined speed while the lever is being tilted.

Such a configuration allows the operator to change and adjust the relative positions of the workpiece W and the grinding wheel 10 in the up-and-down direction. Put another way, the operator can efficiently change and adjust the relative positions of the workpiece W and the detection sensor 20 in the up-and-down direction by turning the up-and-down jog feed switch 25 by a manual operation.

Here, the travel speed of the wheel head 11 by the operation of the up-and-down jog feed switch 25, that is, the feeding speed by the feeding means is set at a higher speed than the feeding speed by the operation of the up-and-down feed handle 24.

For example, the feeding speed by the operation of the up-and-down jog feed switch 25 may be set at 500 to 2000 mm/min, preferably 500 to 1000 mm/min. Consequently, the grinding wheel 10 and the detection sensor 20 are fed at high speed by the input of an operation by use of the up-and-down jog feed switch 25, which allows a reduction in the feeding time, and efficient measurement and grinding.

The front-and-back jog feed switch 28 is an operating means used to input an instruction to feed the saddle 16 at high speed in the horizontal front-and-back direction, that is, the Z direction. The front-and-back jog feed switch 28 is a switch having a lever that allows selection of "forward" or "backward" and tilting. Only while the operator is tilting the lever, the selected "forward" or "backward" signal is transmitted to the control device 4, and the saddle 16 moves in the Z direction at a predetermined speed.

In other words, if the operator tilts the lever of the front-and-back jog feed switch 28 toward "forward", the saddle 16 moves forward at the predetermined speed while the lever is being tilted. If the lever of the front-and-back jog feed switch 28 is tilted toward "backward", the saddle 16 moves backward at the predetermined speed while the lever is being tilted.

Such a configuration allows the operator to change and adjust the relative positions of the workpiece W and the grinding wheel 10 in the horizontal front-and-back direction. Put another way, the operator can efficiently change and adjust the relative positions of the workpiece W and the detection sensor 20 in the horizontal front-and-back direction by tilting the front-and-back jog feed switch 28 by a manual operation.

The travel speed of the saddle 16 by the operation of the front-and-back jog feed switch 28, that is, the feeding speed by the feeding means is set at a higher speed than the feeding speed by the operation of the front-and-back feed handle 27. For example, the feeding speed by the operation of the front-and-back jog feed switch 28 may be set at 500 to 2000 mm/min, preferably 500 to 1000 mm/min. Consequently, the saddle 16 and the workpiece W held above it are fed at high speed by the input of an operation by use of the front-and-back jog feed switch 28, which allows a reduction in the feeding time, and efficient measurement and grinding.

Figure 4:
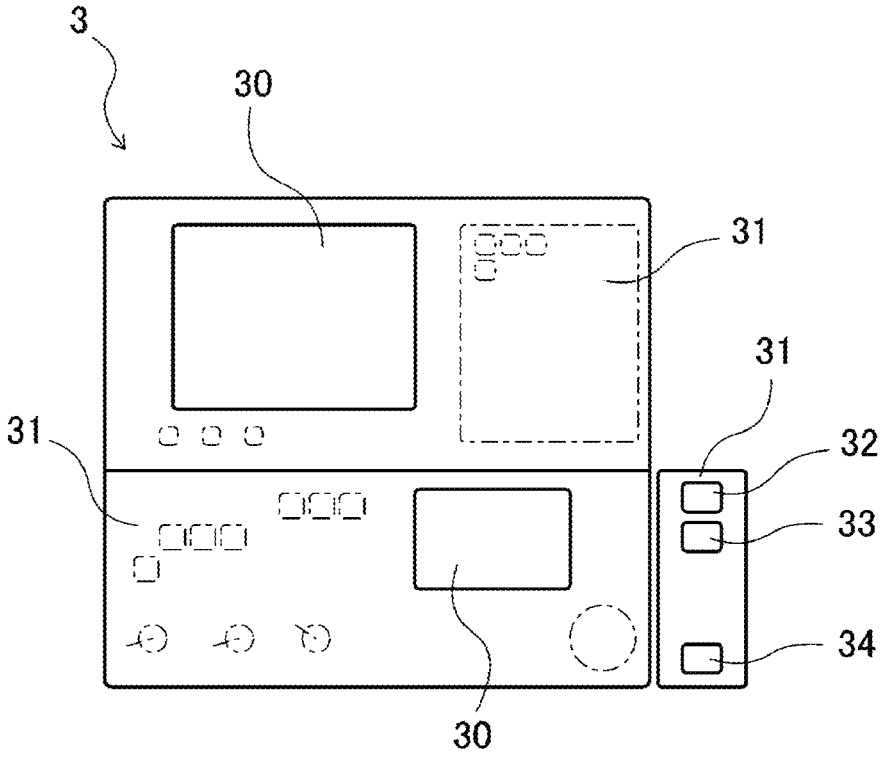
FIG. 4 is a front view schematically illustrating a control panel of the grinding apparatus according to the embodiment of the present invention.

FIG. 4 is a front view schematically illustrating the control panel 3. With reference to FIG. 4, the operating unit 31 of the control panel 3 is provided with, for example, switches that switch between ON and OFF of various functions, switches that switch between various types of automatic control and manual operations, and dials that adjust a feed amount and a cut amount at the time of grinding.

The control panel 3 includes operating means for measuring the workpiece W (refer to FIG. 2). For example, the control panel 3 is provided with a probe up switch 32, a probe down switch 33, and an air blow switch 34, as the operating means used to measure the position of the workpiece W.

The probe up switch 32 is a switch used to input an instruction to store the detection sensor 20 (refer to FIG. 2) at a retraction position to prevent the detection sensor 20 from coming into contact with, for example, the workpiece W or the work table 14 (refer to FIG. 2) during, for example, grinding. If the operator presses the probe up switch 32, the detection sensor 20 is raised by the feeding means 29 and stored at the retraction position.

The probe down switch 33 is a switch used to input an instruction to move the detection sensor 20 from the retraction position to a measurement position to measure the workpiece W. If the operator presses the probe down switch 33, the detection sensor 20 is fed by the feeding means 29 from the retraction position to the measurement position.

The air blow switch 34 is a switch used to input an instruction to blow air on the vicinity of the work surface of the workpiece W. If the operator presses the air blow switch 34, compressed air is supplied from, for example, an unillustrated compressor and blown on the workpiece W. Consequently, the grinding debris and grinding fluid that have adhered to the workpiece W are blown off. Hence, the air blow switch 34 is switched before the measurement of the workpiece W, which allows highly accurate measurement.

Moreover, the control panel 3 is provided with the display unit 30 that displays various kinds of information on grinding. The display unit 30 is, for example, a liquid crystal display, and may be a touch display having a screen that the operator can touch for input. When the workpiece W is measured, the display unit 30 provides a manual measurement screen and displays, for example, position information on a reference point and a measurement point.

Next, the step of measuring the work surface of the workpiece W is described in detail with reference to FIGS. 5 to 7.

Figure 5:
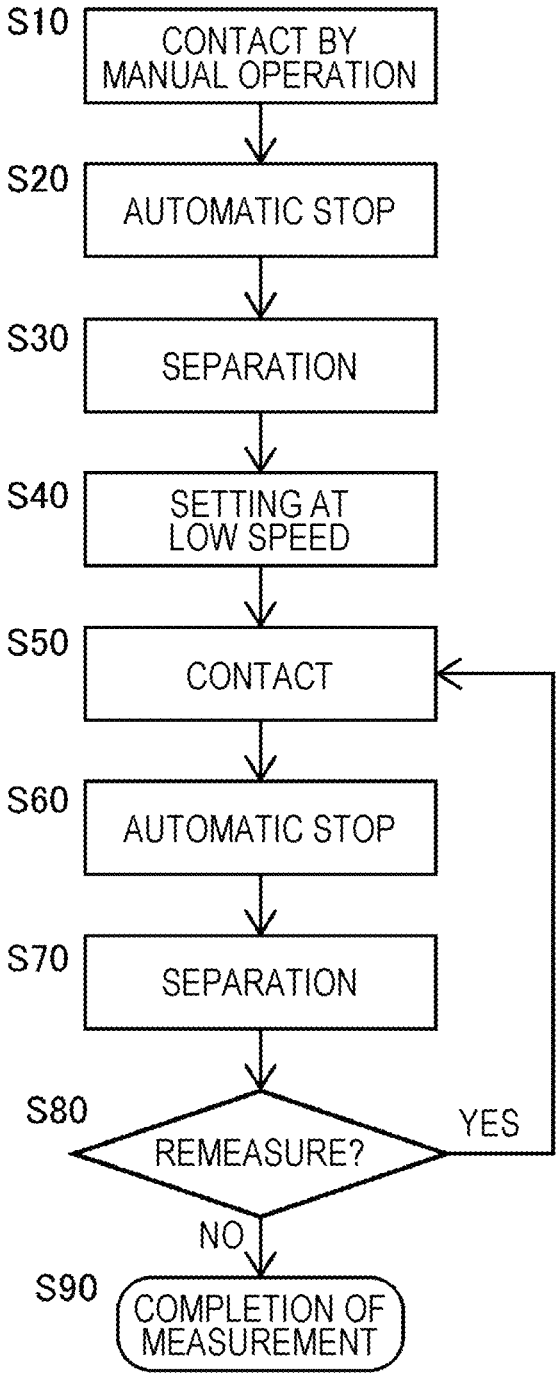
FIG. 5 is a flowchart illustrating the step of measuring the dimension of a workpiece of the grinding apparatus according to the embodiment of the present invention.

FIG. 5 is a flowchart illustrating the step of measuring the dimension of the workpiece W. With reference to FIG. 5, firstly, as step S10, an instruction to change the relative positions of the detection sensor 20 (refer to FIG. 2) and the work table 14 (refer to FIG. 2) by a manual operation by the operator and bring the detection sensor 20 into contact with the workpiece W (refer to FIG. 2) is inputted.

Specifically, the detection sensor 20 is fed to the vicinity of the measurement point of the workpiece W, for example, above the measurement point, by a manual operation of the operating means such as the up-and-down feed handle 24, the left-and-right feed handle 26, the front-and-back feed handle 27, the up-and-down jog feed switch 25, and the front-and-bac jog feed switch 28, which are illustrated in FIG. 3.

For example, the operator then tilts the lever of the up-and-down jog feed switch 25 toward "down" by a manual operation, and the detection sensor 20 is lowered to come into contact with the work surface of the workpiece W.

Note that the step of bringing the detection sensor 20 into contact with the workpiece W may be performed by operating the operating means other than the up-and-down jog feed switch 25. Moreover, the measurement point of the workpiece W is not limited to the top surface of the workpiece W, and may be, for example, the side surface of the workpiece W.

In step S10, when the operator brings the feeding means into operation by a manual operation and the detection sensor 20 comes into contact with the workpiece W, then the step of automatically stopping the relative movement between the detection sensor 20 and the workpiece W is performed next in step S20.

Specifically, when the detection sensor 20 comes into contact with the workpiece W, then information on the contact with the workpiece W detected by the detection sensor 20 is transmitted to the control device 4 (refer to FIG. 1). The control device 4, which has received the information on the contact between the detection sensor 20 and the workpiece W, transmits a signal to stop the feed to the feeding means, and stops the motion of the feeding means.

In step S20 in which the relative movement between the detection sensor 20 and the workpiece W is stopped, the feed by the feeding means is automatically stopped even if the operator continues to press the operating means such as the up-and-down jog feed switch 25. Hence, for example, damage caused by the detection sensor 20 being strongly pressed against the workpiece W is prevented.

The control device 4 then calculates the position coordinate of the contact point of the workpiece W by a computation, on the basis of the contact signal detected by the detection sensor 20, and records the position coordinate in, for example, ROM or RAM. The position coordinate may be computed by taking in a machine coordinate value from, for example, a preset auxiliary macro. Moreover, the measured value of the workpiece W may be displayed on, for example, the display unit 30 of the control panel 3 illustrated in FIG. 4.

When the relative movement between the detection sensor 20 and the workpiece W is stopped in step S20, then the step of separating the detection sensor 20 and the workpiece W is executed in step S30. For example, if the detection sensor 20 is lowered by the manual operation of the up-and-down jog feed switch 25 and comes into contact with the workpiece W, the detection sensor 20 is fed upward by the feeding means even while the operator continues to operate the up-and-down jog feed switch 25.

Next, in step S40, the step of setting the speed of the relative movement between the detection sensor 20 and the workpiece W at a low speed is performed. Specifically, if a measurement is performed by the manual operation of the up-and-down jog feed switch 25 as described above, control of reducing the lowering speed of the detection sensor 20 is performed. Consequently, subsequent measurements can be performed with high accuracy.

Next, in step S50, the operator inputs an instruction to bring the detection sensor 20 and the workpiece W near to each other again, by a manual operation. Consequently, the feeding means feeds the detection sensor 20 or the workpiece W, and the detection sensor 20 and the workpiece W come near to each other and then into contact with each other again. In the example, the detection sensor 20 is lowered and brought into contact with the workpiece W by the manual operation of the up-and-down jog feed switch 25.

Moreover, in step S50, the detection sensor 20 or the workpiece W may be fed by an automatic operation by the control device 4 instead of the manual operation by the operator. In other words, the feeding means is automatically controlled by the control device 4, the detection sensor 20 or the workpiece W is fed, and the detection sensor 20 and the workpiece W come near to each other and then into contact with each other again. In the example, the detection sensor 20 is lowered and brought into contact with the workpiece W under automatic control of the control device 4.

In step S50, control is performed in such a manner that the detection sensor 20 or the work table 14 is fed at a lower speed than the first time and the detection sensor 20 and the workpiece W are brought into contact with each other. In other words, the speed at which the detection sensor 20 and the workpiece W come near to each other is set at a lower speed than the setting speed of, for example, the up-and-down jog feed switch 25 in step S40. Hence, the detection sensor 20 and the workpiece W come near to and into contact with each other at the lower speed than the first time.

In more detail, the feeding speed of the detection sensor 20 or the work table 14 may be set at, for example, 10 to 50 mm/min, preferably 20 to 30 mm/min. This allows highly accurate fine measurement.

When, on the basis of a manual operation by the operator or an automatic operation by the control device 4, the feeding means is brought into operation at the lower speed and the detection sensor 20 comes into contact with the workpiece W in step S50, then the step of automatically stopping the relative movement between the detection sensor 20 and the workpiece W is performed next in step S60.

Specifically, when the detection sensor 20 comes into contact with the workpiece W, then information on the contact with the workpiece W detected by the detection sensor 20 is transmitted to the control device 4. The control device 4 then transmits a signal to stop the feed to the feeding means, and stops the motion of the feeding means.

In step S60 in which the relative movement between the detection sensor 20 and the workpiece W is stopped, the feed by the feeding means is automatically stopped even if the operator continues to operate the operating means such as the up-and-down jog feed switch 25. Hence, for example, damage caused by the detection sensor 20 being strongly pressed against the workpiece W is prevented.

The control device 4 then calculates the position coordinate of the contact point of the workpiece W by a computation on the basis of the contact signal detected by the detection sensor 20, which came into contact at the lower speed than the first time, and records the position coordinate in, for example, ROM or RAM. The position coordinate may be computed by taking in a machine coordinate value from, for example, a preset auxiliary macro. Moreover, the measured value of the workpiece W may be displayed on, for example, the display unit 30 of the control panel 3.

When the relative movement between the detection sensor 20 and the workpiece W is stopped in step S60, then the step of separating the detection sensor 20 and the workpiece W is executed in step S70. In the example, in step S50, on the basis of the manual operation of the up-and-down jog feed switch 25, or automatic control, the detection sensor 20 is lowered at the lower speed and comes into contact with the workpiece W. Even if the operator is still operating the up-and-down jog feed switch 25, the detection sensor 20 stops automatically in step S60 and is automatically fed upward by the feeding means in step S70.

Next, if the operator judges in step S80 that he/she wants to perform a measurement at the same measurement point again, the manual operation of the operating means in step S50 is performed, and the measurement from steps S50 to S70 can be repeatedly performed. Moreover, it may be judged that a measurement at the same measurement point is required again under automatic control by the control device 4, and the automatic measurement from steps S50 to S70 may be repeatedly performed.

As described above, the grinding apparatus 1 can efficiently and repeatedly perform highly accurate measurements in which the feeding speed of the detection sensor 20 or the workpiece W is reduced. Hence, while a first measurement is performed by an easy manual operation, measurement accuracy can be increased by measurements by second and subsequent manual or automatic operations.

When a required number of measurements based on the contact of the detection sensor 20 is performed, the procedure moves on from step S80 to step S90, and the operator inputs an instruction to complete the measurement. Moreover, the instruction to complete the measurement may be given under automatic control by the control device 4 instead of by an operation by the operator. The operator may give the instruction to complete the measurement, for example, by operating, for example, a soft key provided on, for example, the display unit 30 or the operating unit 31 (refer to FIG. 4) of the control panel 3.

Specifically, the control device 4 may detect the instruction to complete the measurement, for example, by the operator pressing a soft key indicating a measured value number twice.

When the operator inputs the instruction to complete the measurement, or on the basis of automatic detection by the control device 4, then the control device 4 completes the measurement and records the measured coordinate value.

As described above, without the preliminary preparations for measurement, such as the creation of an NC program, initial settings, and operation confirmation, the grinding apparatus 1 can perform a highly efficient measurement in which the time for the preliminary preparations is significantly reduced owing to a first measurement based on the manual operation by the operator. Hence, it is possible to significantly increase the productivity of the grinding apparatus 1 in terms of the workpiece W.

Figure 6:
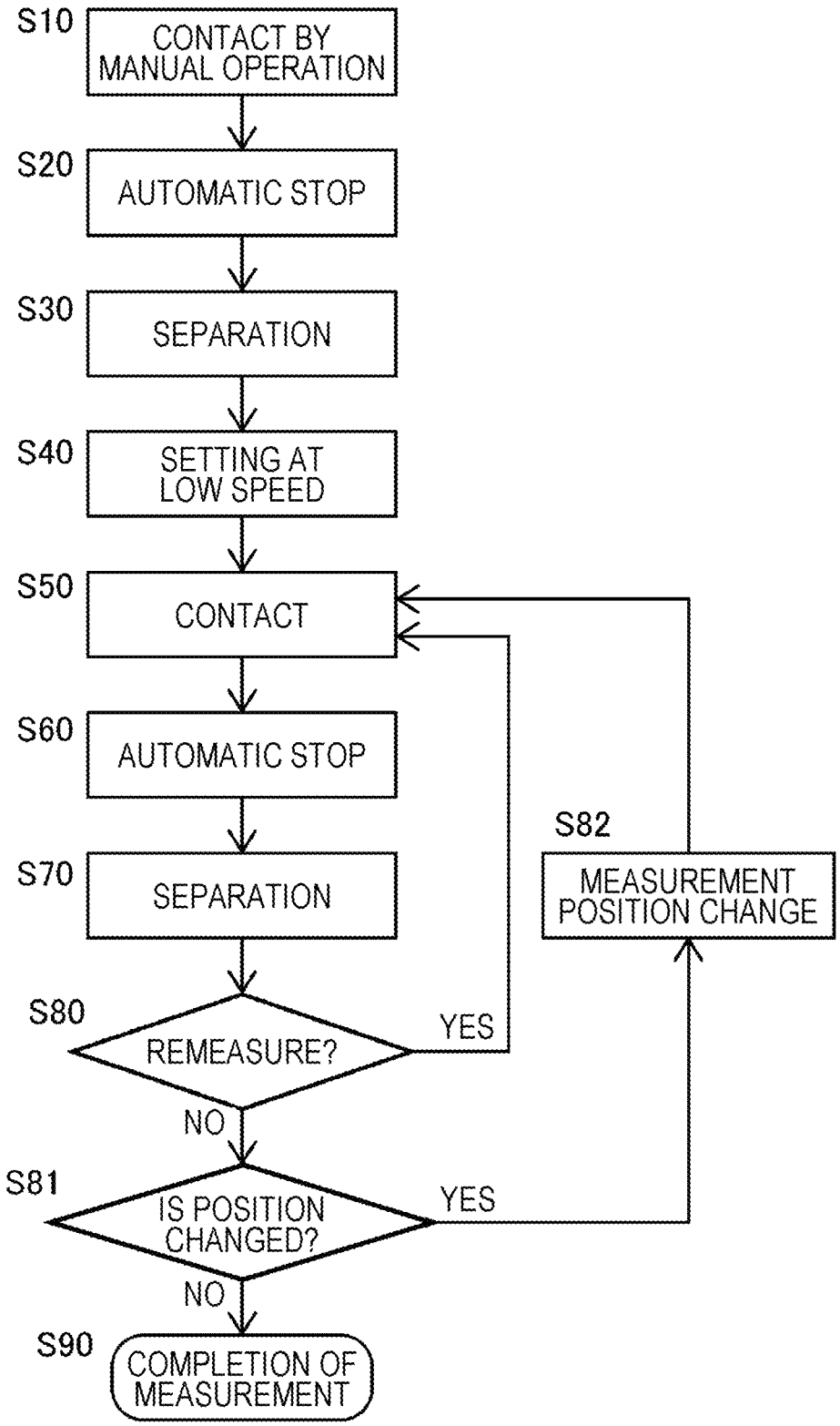
FIG. 6 is a flowchart illustrating another example of the step of measuring the dimension of the workpiece of the grinding apparatus according to the embodiment of the present invention.

FIG. 6 is a flowchart illustrating another example of the step of measuring the dimension of the workpiece W. Note that in FIG. 6 the same reference numerals are assigned to steps similar to those already described with reference to FIG. 5, and descriptions thereof are omitted.

As illustrated in FIG. 6, the contact point may be changed to perform the low-speed measurement step from steps S50 to S70 at a plurality of points.

Specifically, a first measurement is performed at high speed at a predetermined position by the manual operation from steps S10 to S30, the speed is set at a lower speed in step S40, and then the measurement step from steps S50 to S70 is executed a required number of times. If it is judged in step S80 that a remeasurement at the measurement point is not required, the procedure moves on to step S81, and it is judged whether or not a measurement at a changed position is required.

If it is judged in step S81 that a measurement at a changed position is required, control of changing the measurement point is performed in step S82. Specifically, the control device 4 (refer to FIG. 1) controls the feeding means to feed the detection sensor 20 (refer to FIG. 2) or the workpiece W (refer to FIG. 2) and move the detection sensor 20 and the workpiece W relative to each other.

For example, if the dimension of the workpiece W in the up-and-down direction (Y direction) is measured by lowering the detection sensor 20, the detection sensor 20 or the workpiece W is fed in the left-and-right horizontal direction (X direction) and the front-and-back horizontal direction (Z direction), and the relative positions of the detection sensor 20 and the workpiece W in the horizontal direction are changed in step S82.

In terms of a new measurement point obtained by changing the position, the detection sensor 20 and the workpiece W are then fed in such a manner as to come near to each other and come into contact with each other in step S50, and a new measured value is obtained. The automatic stop step in step S60 and the separation step in step S70 are subsequently executed. It is judged in step S80 whether or not to perform a remeasurement. Repeated measurements are performed a required number of times.

If it is judged in step S80 that the required number of measurements has been completed at the new measurement point, the procedure moves on to step S81, and it is judged whether or not a measurement at a further changed position is required. If it is judged in step S81 that a measurement at still another position is required, the procedure moves on to the step of changing the position in step S82 as described above, and the measurement point is changed to another new measurement point.

If it is determined in step S81 that a change to a new position is not required since measurements at all measurement points have been completed, the procedure moves on to step S90, and the measurement is completed.

As described above, the grinding apparatus 1 can change the position of the measurement point under automatic control and perform highly accurate measurements at a plurality of measurement points. For example, the dimensions of the workpiece W can be accurately measured at four additional measurement points a predetermined distance away around a first measurement point in the front-and-back direction and in the left-and-right direction, that is, a total of five measurement points including the first measurement point. Moreover, it is also possible to perform measurements at more measurement points. As described above, measurements can be performed at a plurality of measurement points. Therefore, flatness, the degree of inclination, and other geometric tolerances can be measured accurately.

Figure 7:
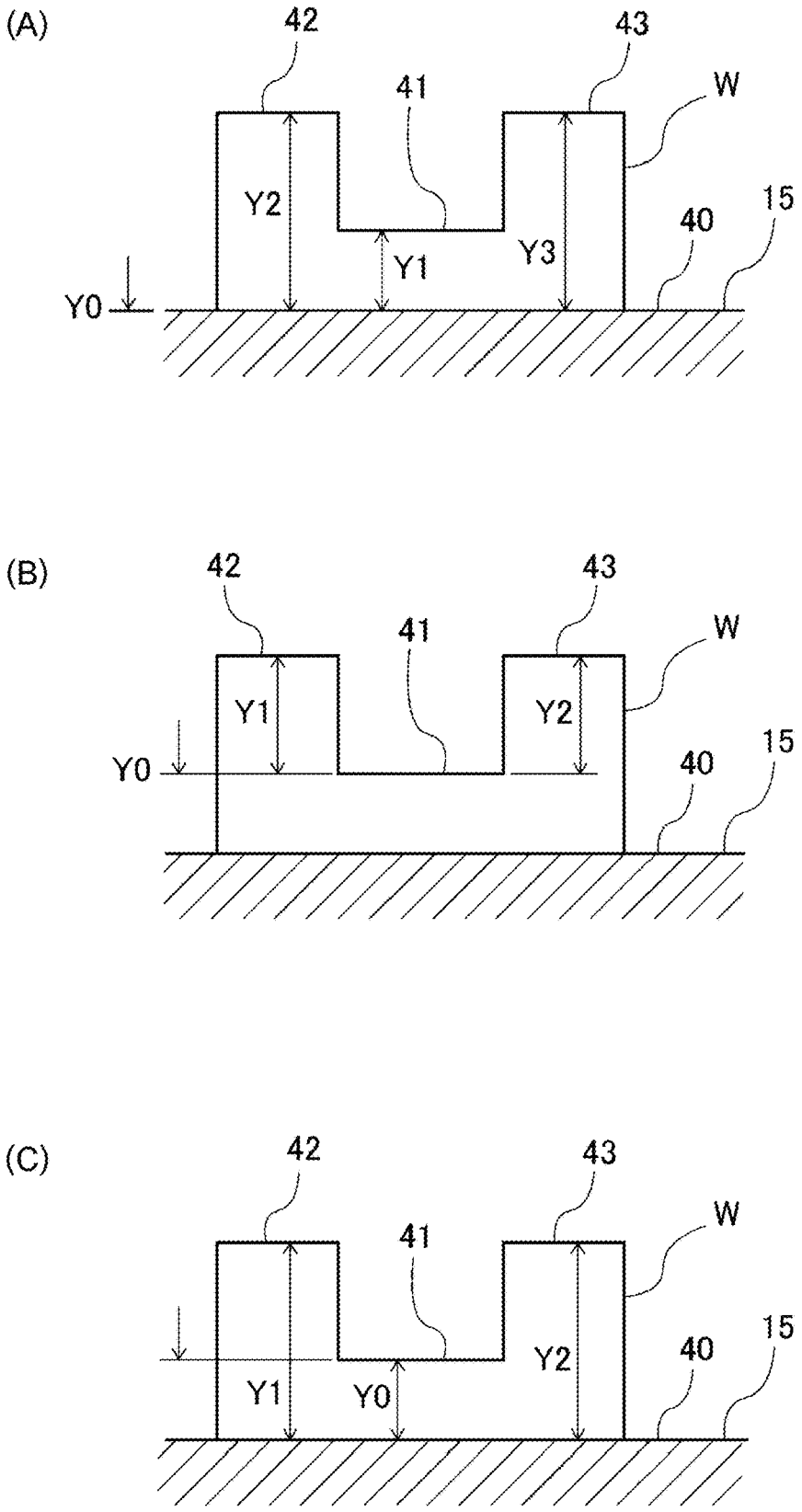
FIG. 7 is diagrams of the grinding apparatus according to the embodiment of the present invention, illustrating (A) an example in which a top surface of a chuck is used as a measurement reference, (B) an example in which a top surface of the workpiece is used as the measurement reference, and (C) an example in which a preset value is set with the top surface of the workpiece as the measurement reference.

FIG. 7 is diagrams illustrating examples of the measurement of the dimension of the workpiece W by the detection sensor 20. FIG. 7 is examples of the measurement of the height dimension, that is, the dimension in the Y direction, of the workpiece W. FIG. 7(A) illustrates an example in which a top surface 40 of, for example, the chuck 15 is used as a measurement reference Y0, FIG. 7(B) illustrates an example in which a top surface 41 of the workpiece W is used as the measurement reference Y0, and FIG. 7(C) illustrates an example in which a preset value is set with the top surface 41 of the workpiece W as the measurement reference Y0.

As illustrated in FIG. 7(A), the workpiece W may be measured with the top surface 40 of the chuck 15 or a top surface of, for example, an unillustrated reference block as the measurement reference Y0 in the Y direction. Specifically, firstly, the steps from steps S10 to S90, which are illustrated in FIG. 5, are executed on, for example, the top surface 40 of the chuck 15, or the top surface of the reference block, and the measurement reference Y0 as the reference point is measured and recorded. The coordinate value of the measurement reference Y0 is "0".

Next, the steps from steps S10 to S90 are executed with the top surface 41 of the workpiece W as a measured surface, and the measurement result is recorded as a measured value Y1. For example, in step S90 in which the measurement is completed, "Y1" is pressed twice and inputted as a measured value number to record the measured value Y1.

The measured value Y1 is a coordinate value in the Y direction relative to the measurement reference Y0. In other words, the measured value Y1 is a height dimension of the top surface 41 of the workpiece W relative to the top surface 40 of the chuck 15 or the top surface of, for example, the reference block.

Similarly, other places of the workpiece W that need to be measured, for example, top surfaces 42 and 43, are measured, and coordinate values of, for example, measured values Y2 and Y3 are recorded. The number of measurement places that can be measured and recorded, that is, the number of measured value numbers is, for example, 16. It is also possible to further increase the number of measurement places that can be measured and recorded.

As illustrated in FIG. 7(B), the measurement reference Y0 in the Y direction of the workpiece W may be measured with a predetermined position of the workpiece W, for example, a predetermined position of the top surface 41, as the reference point. In other words, firstly, the measurement step from steps S10 to S90 are executed on the top surface 41 of the workpiece W used as the reference point, and the measurement reference Y0 is measured and recorded. The coordinate value of the measurement reference Y0 is then set at "0".

Next, the steps from steps S10 to S90 are executed with the other places of the workpiece W, for example, the top surfaces 42 and 43, as the measured surfaces, and the measurement results are recorded as, for example, the measured values Y1 and Y2. For example, the measured values Y1 and Y2 may be recorded by pressing, for example, target soft keys indicating the measured value numbers twice, in step S90 in which the measurement is completed, as in the above description.

For example, the measured values Y1 and Y2 are coordinate values in the Y direction relative to the measurement reference Y0. In other words, for example, the measured values Y1 and Y2 are height dimensions of, for example, the other top surfaces 42 and 43 of the workpiece W relative to the reference point of the top surface 41 of the workpiece W.

Moreover, as illustrated in FIG. 7(C), the workpiece W is measured with a predetermined position of the workpiece W, for example, the top surface 41, as the measurement reference Y0 in the Y direction, and furthermore the measured measurement reference Y0 being the reference point may be recorded as a preset coordinate value.

In other words, firstly, the measurement steps from steps S10 to S90 are executed on the top surface 41 of the workpiece W intended to serve as the reference surface, and the measurement reference Y0 is measured. The machine coordinate value measured here is converted into the preset coordinate value, and recorded.

The steps from steps S10 to S90 are then executed with other places of the workpiece W, for example, the top surfaces 42 and 43 as the measured surfaces, and the measurement results are recorded as, for example, the measured values Y1 and Y2. For example, the measured values Y1 and Y2 may be recorded by pressing target soft keys indicating measured value numbers twice, in step S90 in which the measurement is completed, as in the above description.

For example, the measured values Y1 and Y2 recorded as described above are coordinate values in the Y direction in a case where the measurement reference Y0 is set as a preset reference coordinate value. In other words, for example, Y1 and Y2 are coordinate values obtained by adding the preset coordinate value of the measurement reference Y0 to the height dimensions from the top surface 41 of the workpiece W being the reference point to, for example, the other top surfaces 42 and 43 of the workpiece W.

Next, the steps of measuring and machining the work surface of the workpiece W are described in detail with reference to FIG. 8.

Figure 8:
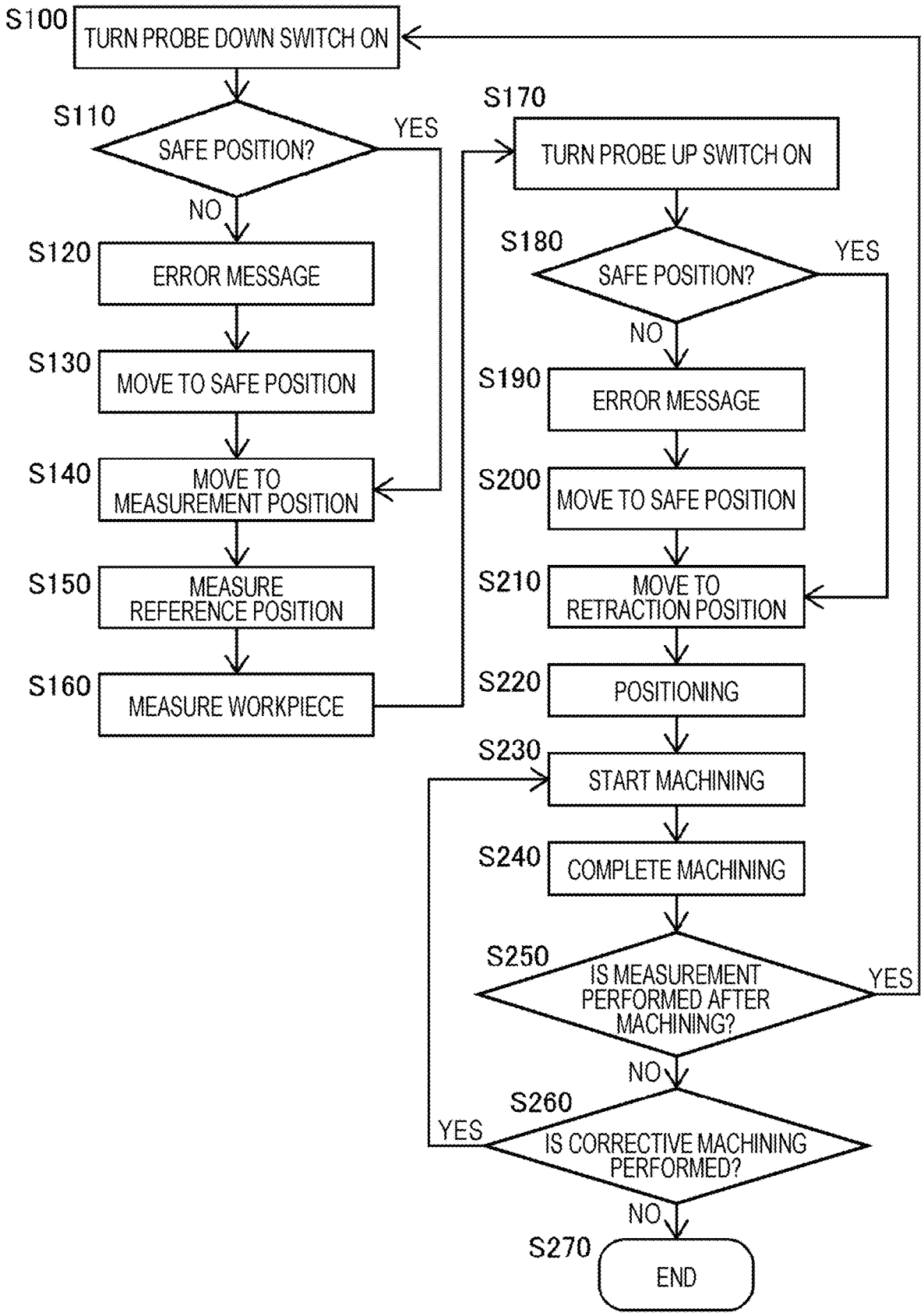
FIG. 8 is a flowchart illustrating the steps of measuring and grinding the workpiece in the grinding apparatus according to the embodiment of the present invention.

FIG. 8 is a flowchart illustrating the steps of measuring and grinding the workpiece W in the grinding apparatus 1. Firstly, as illustrated in FIG. 2, the workpiece W is placed on the top surface of the chuck 15 of the work table 14 and held by the chuck 15.

With reference to FIG. 8, in step S100, the operator presses the probe down switch 33 (refer to FIG. 4) to input an instruction to feed the detection sensor 20 (refer to FIG. 2) from the retraction position to the measurement position.

When the operator presses the probe down switch 33 in step S100, then the control device 4 (refer to FIG. 1) checks whether or not the detection sensor 20 can be safely fed to the measurement position without coming into contact with, for example, the workpiece W and the chuck 15 in step S110.

If confirming in step S110 that the detection sensor 20 can be safely fed to the measurement position, the control device 4 moves on to step S140 and feeds the detection sensor 20 to the measurement position.

On the other hand, if judging that the detection sensor 20 cannot be safely fed to the measurement position, the control device 4 moves on to a step in step S120 and displays an error message on, for example, the display unit 30 (refer to FIG. 3) of the control panel 3 (refer to FIG. 3).

In step S130, the operator, who has viewed the error message in step S120, manually operates the operating means such as the up-and-down jog feed switch 25 to drive the feeding means, and moves the detection sensor 20 to a safe position where the detection sensor 20 can be safely fed to the measurement position.

In step S130, when detecting that the detection sensor 20 has moved to the safe position where the detection sensor 20 can be safely fed to the measurement position, then the control device 4 moves on to step S140 and feeds the detection sensor 20 to the measurement position.

Note that all the steps from step S110 in which the safe position of the detection sensor 20 is checked to step S130 in which the detection sensor 20 is fed to the safe position may be performed under automatic control by the control device 4. Consequently, the operator is simply required to perform only the manual operation of pressing the probe down switch 33 in step S100, which reduces the work load and enables the measurement of the workpiece W with an easy operation.

After the detection sensor 20 is fed to the measurement position in step S140, in step S150, a reference position measurement step is executed in which the operator changes the relative positions of the detection sensor 20 and the work table 14 by a manual operation to bring the detection sensor 20 into contact with the workpiece W and measure the reference point.

The reference point is measured in the measurement steps from steps S10 to S90 illustrated in FIG. 5. As already described, the reference point is, for example, a predetermined position of the chuck 15, the reference block, or the workpiece W. Consequently, the coordinate value of the measurement reference Y0 (refer to FIG. 7) is measured and recorded.

Next, in step S160, a workpiece measurement step is executed in which the operator changes the relative positions of the detection sensor 20 and the work table 14 by a manual operation to bring the detection sensor 20 into contact with the workpiece W, and measure the workpiece W.

In the measurement of the workpiece W in step S160, the steps from steps S10 to S90 illustrated in FIG. 5 are executed for each measurement point. Consequently, the measurement result of each measurement point is recorded as, for example, the measured values Y1 or Y2 (refer to FIG. 7).

When the workpiece measurement step (step S160) is completed, then in step S170 the operator presses the probe up switch 32 (refer to FIG. 4) and inputs an instruction to store the detection sensor 20 at the retraction position.

When the operator presses the probe up switch 32 in step S170, then the control device 4 checks whether or not the detection sensor 20 can be safely fed to the retraction position without coming into contact with, for example, the workpiece W and the chuck 15, in step S180.

If confirming in step S180 that the detection sensor 20 can be safely fed to the retraction position, the control device 4 moves on to step S210 and feeds the detection sensor 20 to the retraction position.

On the other hand, if judging in step S180 that the detection sensor 20 cannot be safely fed to the retraction position, the control device 4 moves on to a step in step S190 and displays an error message on, for example, the display unit 30 of the control panel 3.

In step S200, the operator, who has viewed the error message in step S190, manually operates the operating means such as the up-and-down jog feed switch 25 to drive the feeding means, and moves the detection sensor 20 to the safe position where the detection sensor 20 can be safely fed to the retraction position.

In step S200, when detecting that the detection sensor 20 has moved to the safe position where the detection sensor 20 can be safely fed to the retraction position, then the control device 4 moves on to step S210 and feeds the detection sensor 20 to the retraction position.

Note that all the steps from step S180 in which the safe position of the detection sensor 20 is checked to step S200 in which the detection sensor 20 is fed to the safe position may be performed under automatic control by the control device 4. Consequently, the operator is simply required to perform only the manual operation of pressing the probe up switch 32 in step S170, which reduces the work load.

When the detection sensor 20 is stored in the retraction position in step S210, then a positioning step of feeding the detection sensor 20 and the work table 14 to a predetermined machining start position by the feeding means is performed in step S220.

The operator moves the detection sensor 20 and the work table 14 by a manual operation. Note that the positioning step (step S220) may be automatically performed under the control of the control device 4. For example, the control device 4 can perform automatic positioning at a recorded previous machining end position.

When the positioning step (step S220) is performed, then the grinding process on the workpiece W is started in step S230, and the grinding process is completed in step S240. As described above, the machining method is a method in which the rotating grinding wheel 10 comes into contact with the work surface of the workpiece W that moves relative to the grinding wheel 10 and grinds the work surface.

Next, it is judged in step S250 whether or not a post-machining measurement is required for the workpiece W that has been machined. If a post-machining measurement is required, the procedure returns to step S100, and the step of measuring the workpiece W is performed.

On the other hand, if a post-machining measurement is not required, the procedure moves on to step S260 to judge whether or not to perform corrective machining. If corrective machining is required, the procedure returns to step S230, and the grinding process is performed on the workpiece W.

If it is judged in step S260 that corrective machining is not performed on the workpiece W, the procedure moves on to step S270, and the grinding process ends.

As described above, according to the grinding apparatus 1, the operator can easily and accurately measure the position of a workpiece by manually inputting a measurement instruction into the operating means without preliminary preparations such as creation of an NC program.

Hence, the grinding apparatus 1 can reduce the burden of the preliminary preparations on the operator and also reduce the time for the preliminary preparations significantly, and encourage an increase in the efficiency of workpiece machining.

Specifically, the grinding apparatus 1 can measure the workpiece W without, for example, doing the settings of various parameters that are done by the grinding apparatuses of the known technologies, for example, the setting of a rough/fine measurement distance, the setting of a rough/fine measurement speed, the setting of the safe position, the settings of a left-and-right measurement pitch/the number of left-and-right measurements, the settings of a front-and-back measurement pitch/the number of front-and-back measurements, reference position teaching, workpiece measurement position teaching and input, and operation confirmation. Consequently, it is possible to completely eliminate a time of approximately 830 seconds required for these measurement preparation steps and to encourage a significant time reduction.

Moreover, the measurement performed by feeding the detection sensor 20 at high speed by use of, for example, the up-and-down jog feed switch 25 by a manual operation can also reduce the time for the measurement operations.

Specifically, in the known automatic measurement based on an NC program, the travel speed of the detection sensor 20 is low, and it takes a time of approximately 100 seconds for measurement operations such as travel from the retraction position to the measurement position and vice versa, and measurements (rough measurement/fine measurement) of the reference point and the measurement point.

On the other hand, in the grinding apparatus 1, since the feeding means feeds the detection sensor 20 at high speed by a manual operation of, for example, the up-and-down jog feed switch 25; therefore, the measurement operations can be completed in approximately 40 seconds.

In other words, when comparing total times from the start of the preliminary preparations to the completion of the measurement operations, it takes a time of approximately 930 seconds in the grinding apparatuses of the known technologies, whereas a measurement can be performed in a time of approximately 40 seconds in the grinding apparatus 1 according to the embodiment. In other words, according to the grinding apparatus 1, the measurement time of the workpiece W can be reduced by approximately 890 seconds, and a measurement can be completed in a time that is approximately 4% of the time taken in the known technologies.

In addition, as described above, the grinding apparatus 1 performs the stop control (steps S20 and S60) and the separation control (steps S30 and S70) after the detection sensor 20 and the workpiece W come into contact with each other at high speed. This allows high-speed and safe measurement without damaging, for example, the detection sensor 20 and the workpiece W due to the contact for measurement.

After the first contact and measurement is performed, the grinding apparatus 1 can perform a measurement in which the detection sensor 20 and the workpiece W are brought into contact with each other at a lower speed than the first time, a plurality of times. Consequently, while a first measurement is performed by an easy manual operation, it is possible to efficiently perform highly accurate measurements at low speed for second and subsequent times and to further increase measurement accuracy. The feeding operation that is performed at a lower speed than the first time is also performed at a higher speed than the known technologies, and the measurement operation time required for highly accurate fine measurement can be reduced to approximately 30% of the time in the known technologies.

As described above, the grinding apparatus 1 according to the embodiment can detect the position of the work surface of the workpiece W with high accuracy and high efficiency without preliminary preparations such as the creation of an NC program, and can significantly reduce the measurement time and increase productivity in terms of the workpiece W.

Note that the present invention is not limited to the above embodiment, and various modifications can be made without departing from the gist of the present invention.

LIST OF THE REFERENCE NUMERALS

1 Grinding apparatus
2 Grinding machine
3 Control panel
4 Control device
10 Grinding wheel
11 Wheel head
12 Column
13 Wheel guard
14 Work table
15 Chuck
16 Saddle
17 Frame
18 Cover
20 Detection sensor
21 Probe
22 Contactor
23 Arm
24 Up-and-down feed handle
25 Up-and-down jog feed switch
26 Left-and-right feed handle
27 Front-and-back feed handle
28 Front-and-back jog feed switch
30 Display unit
31 Operating unit
32 Probe up switch
33 Probe down switch
34 Air blow switch
40, 41, 42, 43 Top surface
Y0 Measurement reference
Y1, Y2, Y3 Measured value
W Workpiece

The invention claimed is:

1. A grinding apparatus comprising:

a work table configured to hold a workpiece;

a grinding wheel configured to grind the workpiece while rotating; and a detection sensor configured to detect a position of a work surface of the workpiece in contact with the work surface, wherein the detection sensor is configured to be brought into contact with the workpiece to measure the workpiece, the grinding apparatus, further comprising:

a feeding means configured to feed the detection sensor or the work table and move the detection sensor and the work table relative to each other;

a control device configured to numerically control the feed by the feeding means; and an operating means configured to manually input an instruction of a feeding operation of the feeding means into the control device such that one of the detection sensor or the work table changes a position relative to the other by a manual operation input through the operating means, wherein the control device is configured to control the feeding means by the manual operation of the operating means to bring the detection sensor into contact with the workpiece and record a coordinate of a contact point, after the feeding means causes the detection sensor to come into contact with the workpiece by the manual operation of the operating means, the control device is configured to automatically stop the relative movement by the feeding means between the detection sensor and the work table and then automatically control the feeding means to separate the detection sensor and the workpiece.

2. A grinding apparatus comprising:

a work table configured to hold a workpiece;

a grinding wheel configured to grind the workpiece while rotating; and a detection sensor configured to detect a position of a work surface of the workpiece in contact with the work surface, wherein the detection sensor is configured to be brought into contact with the workpiece to measure the workpiece, the grinding apparatus, further comprising:

a feeding means configured to feed the detection sensor or the work table and move the detection sensor and the work table relative to each other;

a control device configured to numerically control the feed by the feeding means; and an operating means configured to manually input an instruction of a feeding operation of the feeding means into the control device such that one of the detection sensor or the work table changes a position relative to the other by a manual operation input through the operating means, wherein the control device is configured to control the feeding means by the manual operation of the operating means to bring the detection sensor into contact with the workpiece and record a coordinate of a contact point, after the feeding means causes the detection sensor to come into contact with the workpiece and the feeding means causes the detection sensor to separate from the workpiece, the control device is configured to perform control of feeding the detection sensor or the work table at a lower speed than the first time and bringing the detection sensor and the workpiece into contact with each other.

3. The grinding apparatus according to claim 2, wherein after the feeding means causes the detection sensor to come into contact with the workpiece and the feeding means causes the detection sensor to separate from the workpiece, the operating means is configured to be manually operated to bring the detection sensor and the workpiece into contact with each other again, and the control device is configured to perform control of feeding the detection sensor or the work table to bring the detection sensor and the workpiece into contact with each other.

4. The grinding apparatus according to claim 2, wherein after the feeding means causes the detection sensor to come into contact with the workpiece by the manual operation of the operating means and the feeding means causes the detection sensor to separate from the workpiece by automatic control, the control device is configured to feed the detection sensor or the work table by automatic control to bring the detection sensor and the workpiece into contact with and separate from each other.

* * * * *